US006398214B1

(12) United States Patent
Moteki et al.

(10) Patent No.: US 6,398,214 B1
(45) Date of Patent: Jun. 4, 2002

(54) SHEET HANDLING DEVICE AND IMAGE FORMING APPARATUS HAVING SHEET-ALIGNING ROTARY MEMBER

(75) Inventors: Junichi Moteki, Tokyo; Yoshinori Isobe; Katsuhito Kato, both of Toride; Yoshimi Mizuta, Kashiwa; Takeshi Yamada, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/492,112

(22) Filed: Jan. 27, 2000

(30) Foreign Application Priority Data

Jan. 29, 1999 (JP) ..... 11-021808

(51) Int. Cl.[7] ..... B65H 31/26
(52) U.S. Cl. ..... 271/220; 271/314
(58) Field of Search ..... 271/314, 220, 271/207, 3.02, 3.03

(56) References Cited

U.S. PATENT DOCUMENTS

| | | | | |
|---|---|---|---|---|
| 3,847,388 A | * | 11/1974 | Lynch | 271/220 |
| 5,282,611 A | | 2/1994 | Ueda et al. | 270/53 |
| 5,288,062 A | * | 2/1994 | Rizzolo et al. | 271/220 |
| 5,351,112 A | | 9/1994 | Naito et al. | 355/233 |
| 5,579,083 A | | 11/1996 | Naito et al. | 355/50 |
| 5,700,002 A | | 12/1997 | Kato et al. | 270/58.12 |
| 5,819,151 A | | 10/1998 | Naito et al. | 399/367 |
| 5,897,250 A | | 4/1999 | Hirai et al. | 399/404 |
| 5,911,414 A | | 6/1999 | Kato et al. | 270/58.07 |

FOREIGN PATENT DOCUMENTS

| | | | | |
|---|---|---|---|---|
| JP | 0261161 | * | 10/1989 | 271/220 |
| JP | 0106551 | * | 4/1990 | 271/220 |
| JP | 403259857 A | * | 11/1991 | 271/314 |
| JP | 405178513 A | * | 7/1993 | 271/314 |
| JP | 405294530 A | * | 11/1993 | 271/314 |

* cited by examiner

*Primary Examiner*—H. Grant Skaggs
(74) *Attorney, Agent, or Firm*—Fitzpatrick, Cella, Harper & Scinto

(57) ABSTRACT

A sheet handling device has a sheet-aligning rotary member with an ejection device for ejecting sheets into a sheet stacking device, a sheet end stopper for holding the end of the sheet stacked in the sheet stacking device; and at least one rotary member for aligning the sheets ejected in the sheet stacking device with the sheet end stopper. The rotary member has an arc-shape outer peripheral surface around a portion of a circumference of said at least one rotary member.

29 Claims, 10 Drawing Sheets

SHEET HANDLING DEVICE AND IMAGE FORMING APPARATUS HAVING SHEET-ALIGNING ROTARY MEMBER

BACKGROUND OF THE INVENTION

1. Field of the Invention

The present invention relates to a sheet handling device having a sheet-aligning rotary member, and more particularly, to a sheet post-handling device that sequentially receives sheets of copy paper and the like ejected from an image forming apparatus, such as a copying machine, a printer, or a laser beam printer, after image formation, and subjects the sheets to processes, such as alignment and binding, and ejects and stacks the sheets in a stacking section.

2. Description of the Related Art

In image forming apparatuses, such as printing machines, copying machines, and printers, sheets are conveyed for image formation, and are ejected and stacked in an ejection tray after image formation. For the purpose of stacking in alignment, the ejected sheets are aligned in the sheet width direction by a regulating means that is movable in that direction, and are aligned in the sheet feeding direction by a rotary paddle returning the sheet so as to contact an abutting section.

When the sheets are aligned in the sheet feeding direction by a rotary paddle, the amount of deflection of the rotary paddle increases as the number of sheets to be stacked increases, which also increases the contact pressure between the rotary paddle and the sheets. As a result, the sheets may buckle when in contact with the abutting section, or overload may be imposed on the motor.

If the contact pressure is set to be small so that the stacked sheets do not buckle, even when the number of sheets increases, since the returning force decreases, it is necessary to increase the number of revolutions of the rotary paddle, and to turn the rotary paddle a multiple number of turns to align a single sheet. This may result in insufficient time to align the sheets in the sheet width direction. Moreover, since the sheets are aligned in the sheet width direction while in contact with the rotary paddle, the alignment in the sheet width direction may not be smooth.

The rotary paddle produces the returning force from stiffness of the paddles. Since the paddles are generally made of resin material, such as polyurethane, stiffness is likely to change with environmental changes, such as temperature changes, thereby making the contact pressure unstable. Furthermore, when curled paper or the like is aligned by the paddles, the rear end of the paper may be caught by the guide surface of the paddle, which results in alignment failure.

SUMMARY OF THE INVENTION

The present invention has been made in view of the above problems, and an object of the present invention is to provide a sheet handling device and an image forming apparatus equipped with a sheet-aligning rotary member having superior aligning ability.

According to one aspect of the present invention, there is provided a sheet handling device including: a sheet stacking device; an ejection device for ejecting sheets to the sheet stacking device; at least one rotary member having an arc-shaped outer peripheral surface around a portion of its circumference; and a sheet end stopper for holding the ends of the sheets stacked in the sheet stacking device.

The rotary member may be movable in a direction substantially perpendicular to a sheet stacking surface of the sheet stacking device.

In accordance with one aspect of the invention, the rotary member includes a rotation shaft, a support member for supporting the rotation shaft in engagement therewith, a guide portion provided in the support member, and a slide guide device in engagement with the guide portion so as to support the support member slidably in a direction substantially perpendicular to the sheet stacking surface of the sheet stacking device.

In accordance with another aspect of the invention, when the circumferential length of the arc-shaped outer peripheral surface of the rotary member is $l_1$, the length from a contact point between the sheet stacking surface of the sheet stacking device and the outer peripheral surface of the rotary member to the sheet end stopper is $l_2$, and the length from an intersection of a line perpendicularly extending from the outer peripheral surface of the ejection device on the downstream side and the sheet stacking surface of the sheet stacking device to the sheet end stopper is $l_3$, $l_1 \geqq l_2$ and $l_2 \geqq l_3$.

In accordance with still another aspect of the invention, the rotary member has a turning center on the outer peripheral side with respect to the rotation center. Furthermore, the rotary member has a support portion fixed to the rotation center, and an outer peripheral portion supported by the support portion so as to turn on the turning center with respect to the support portion.

A positioning portion may be provided in the support portion so that the outer peripheral portion aligns with a circle formed when the rotary member turns, and an urging device may be provided to urge the outer peripheral portion toward the positioning portion.

At least one of the rotary members may have a high-friction member on the outer peripheral surface thereof. The high-friction member may be detachable from the rotary member, and may be provided at at least two points symmetrical with respect to the ejection center of the sheets to be ejected from the ejection device. The high-friction member may be made of rubber.

According to another aspect of the present invention, there is provided an image forming apparatus comprising image forming means for forming an image on a sheet and a sheet handling device, including: a sheet stacking device; an ejection device for ejecting sheets with an image formed thereon to the sheet stacking device; at least one rotary member placed above the sheet stacking device and having an arc-shaped outer peripheral surface around a portion of a circumference of the rotary member; and a sheet end stopper for holding the ends of the sheets stacked in the sheet stacking device.

According to the above configuration, since the nearly arc-shaped rotary member is turned in contact with the stacked sheets, the amount of return of the sheets can be increased, and a single sheet can be aligned by one turn of the rotary member, which reduces the number of revolutions of the motor. Moreover, this ensures sufficient time for alignment in the sheet width direction. Since the rotary member is arc-shaped, it can be retracted from the sheet stacking space after alignment in the sheet feeding direction, which allows the sheets to be smoothly aligned in the sheet width direction without imposing a load.

Furthermore, since the rotary member has the pressure portion for raking the sheet, whose end remains on the guide surface below the ejection rollers, onto the sheet stacking surface, even curled paper and the like can be reliably aligned.

Even when the number of sheets to be stacked on the stacking device increases or decreases, since the rotary member can move in the direction of thickness of the stacked sheets, the contact pressure thereof does not significantly change and is made uniform, which can conform to a large number of stacked sheets.

As described above, according to the present invention, since the arc-shaped rotary member is turned in contact with the stacked sheets, it is possible to increase the amount of movement of the sheets.

Since the length of the arc-shaped outer peripheral portion of the rotary member is longer than the distance from the sheet landing position to the sheet end stopper, the sheet can be reliably moved to the sheet end stopper by only one turn of the rotary member.

Since the rotary member is movable in the direction of thickness of the sheets, the amount of change in contact pressure due to changes in the number of stacked sheets can be reduced, or a constant and stable alignment amount can be ensured regardless of the number of sheets.

Furthermore, even if a sheet ejected from the ejection device leans on the lower guide, it can be raked by the raking portion provided in the rotary member. This allows the sheet to reliably land on the handling tray and to be moved to the sheet end stopper.

Since the driving-side ejection roller is placed in the upper part of the path, and the return roller is placed in a small space between the path and the post-handling tray, the device can be reduced in size. Since the outer peripheral portion of the return roller is turnable on another center, multiple stacked sheets can be smoothly returned without causing step-out. Since the return roller can retract inside the rear end guide during alignment in the sheet width direction, smooth alignment can be achieved without imposing load. In addition, since the rubber members of the return rollers are placed symmetrically with respect to the sheet ejection center, the sheets can be prevented from skewing during returning operation. Since the rubber members are detachable, maintenance is facilitated.

Further objects, features, and advantages of the present invention will be apparent from the following description of the preferred embodiments with reference to the attached drawings.

DESCRIPTION OF THE PREFERRED EMBODIMENT

Figure 1:
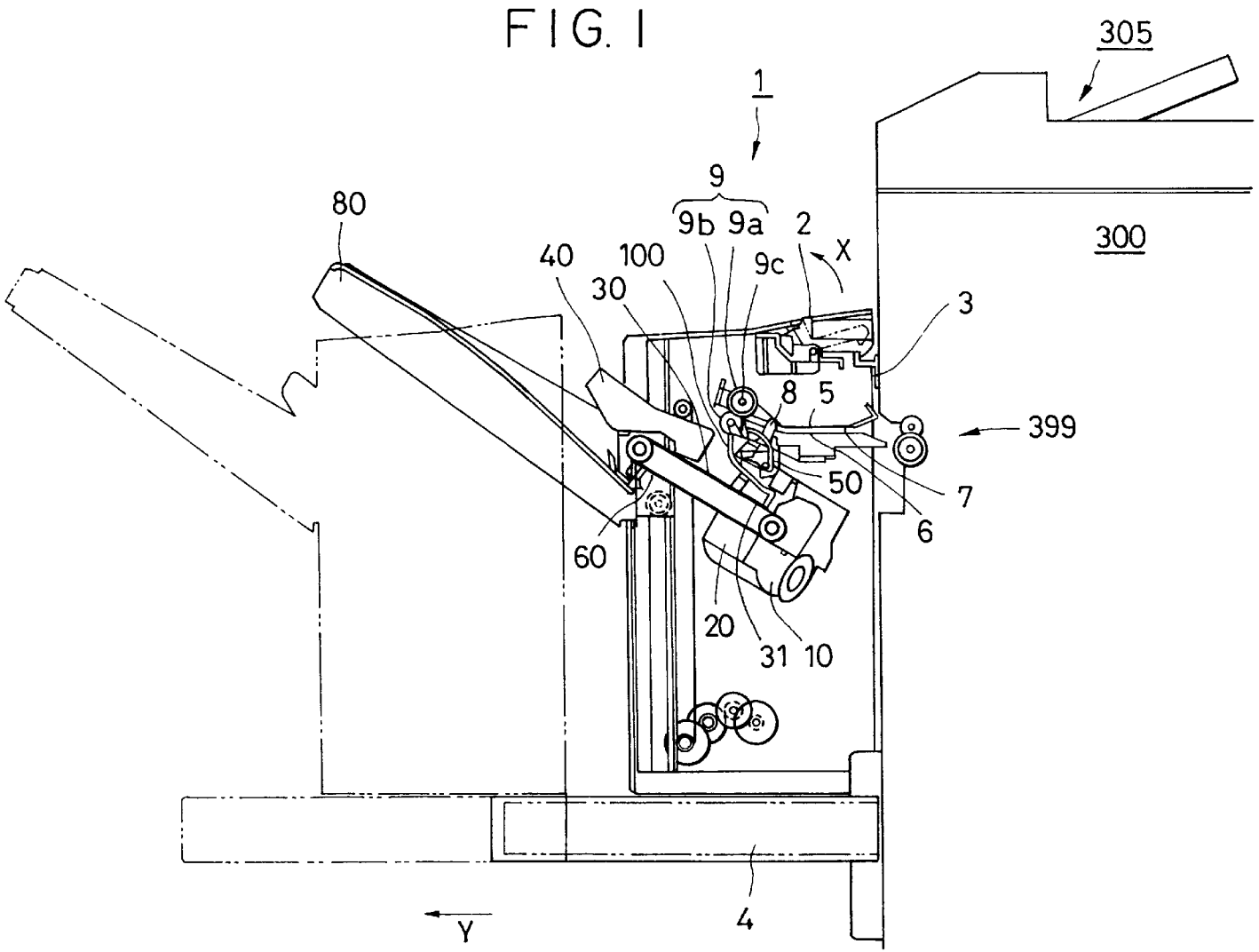
FIG. 1 is an explanatory sectional view showing the configuration of a sheet post-handling device according to the present invention.
Figure 3A:
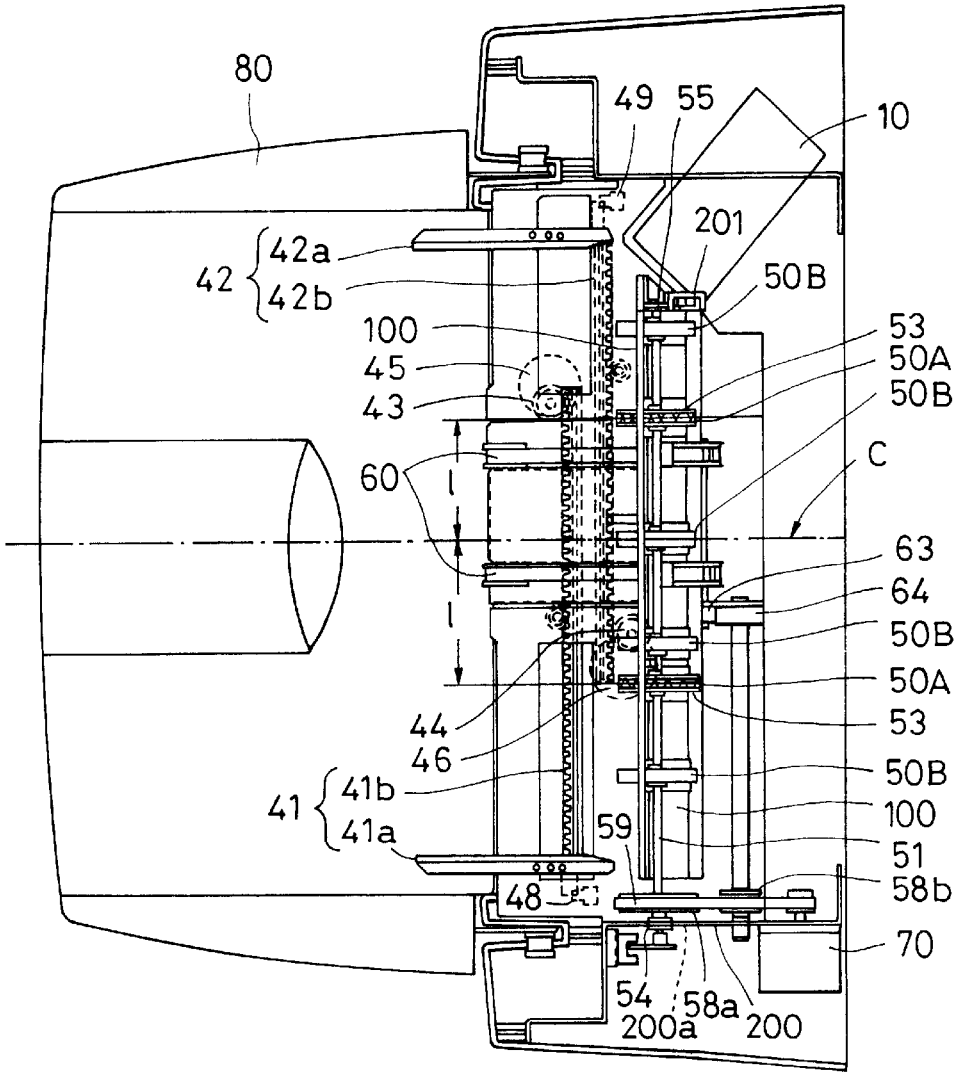
FIGS. 3A, 3B, and 3C are explanatory views of return rollers and a shift mechanism for aligning members provided in a post-handling tray.
Figure 3B:
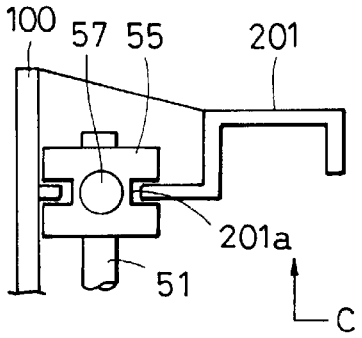
Figure 3C:
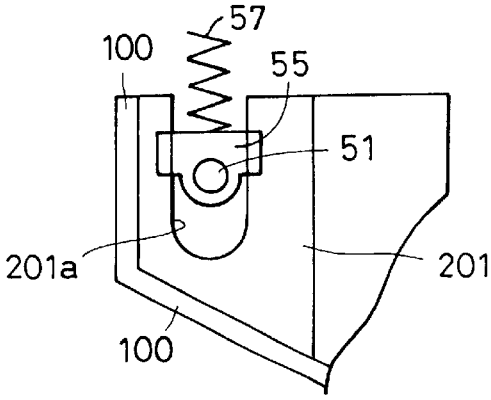
Figure 4C:
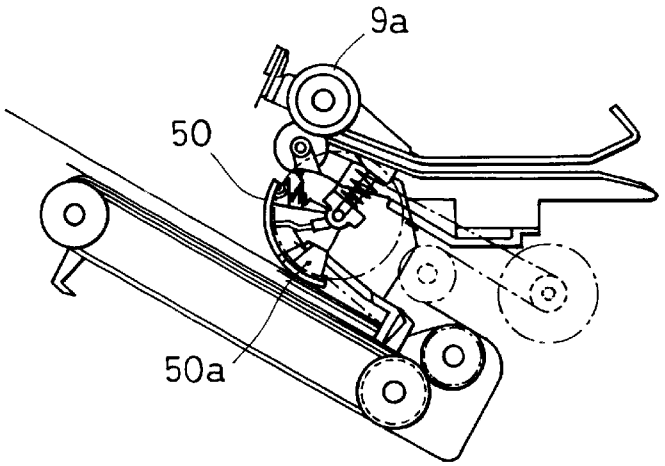
FIGS. 4A, 4B, 4C, and 4D are explanatory views showing the motions of the return roller and a stack ejection belt in the sheet post-handling device.
Figure 4D:
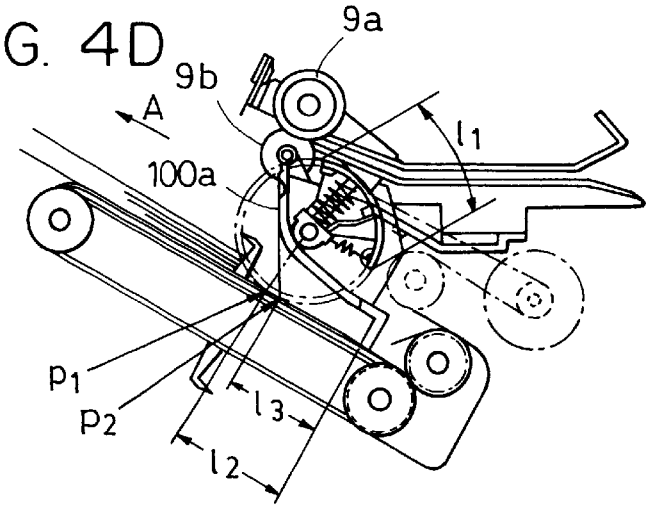
Figure 4A:
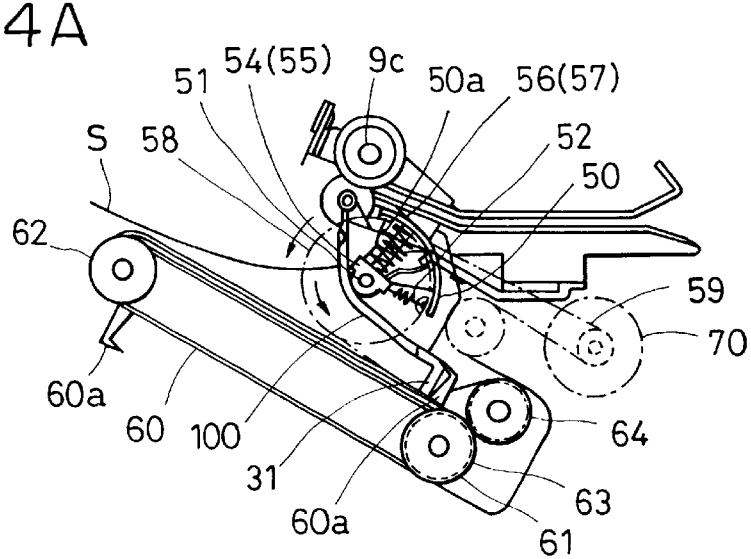
Figure 5:
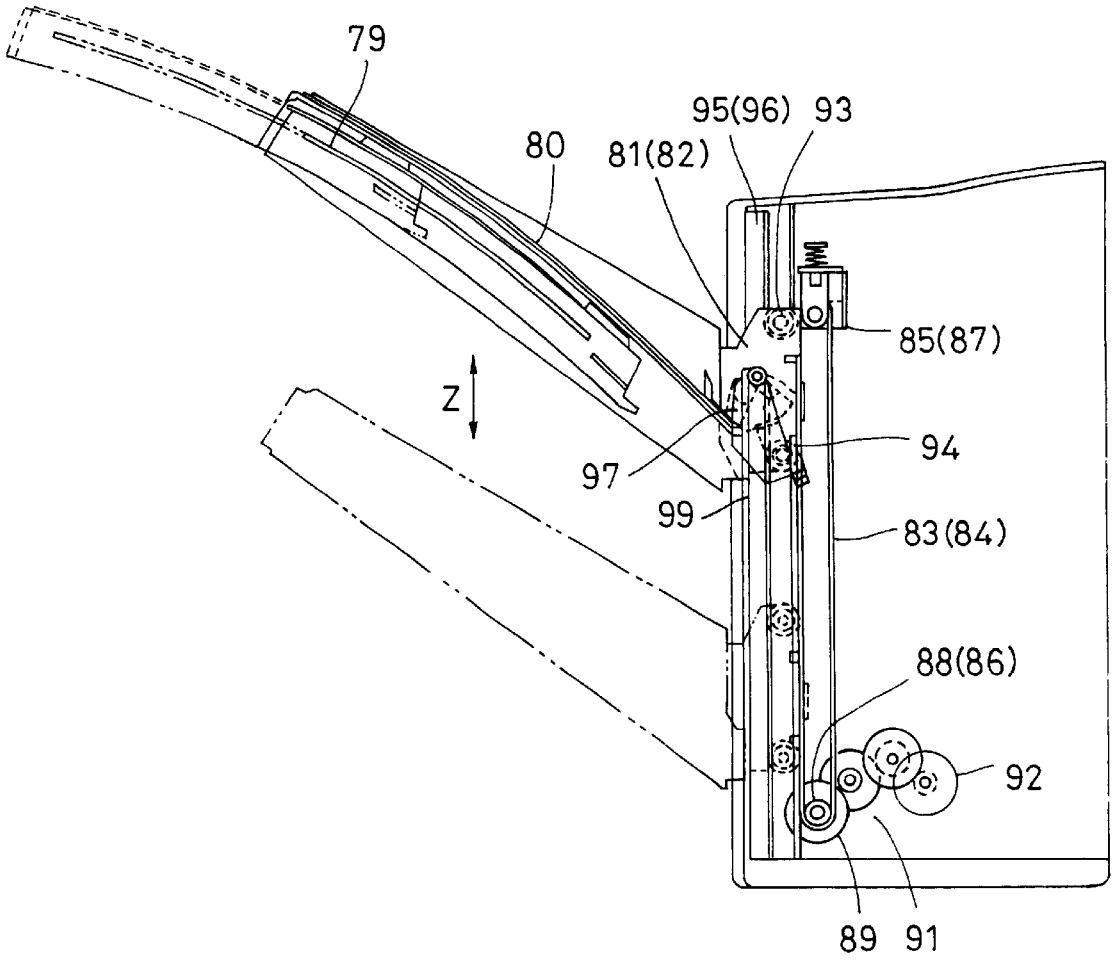
FIG. 5 is a cross-sectional view of a shift mechanism for a stack tray.
Figure 6:
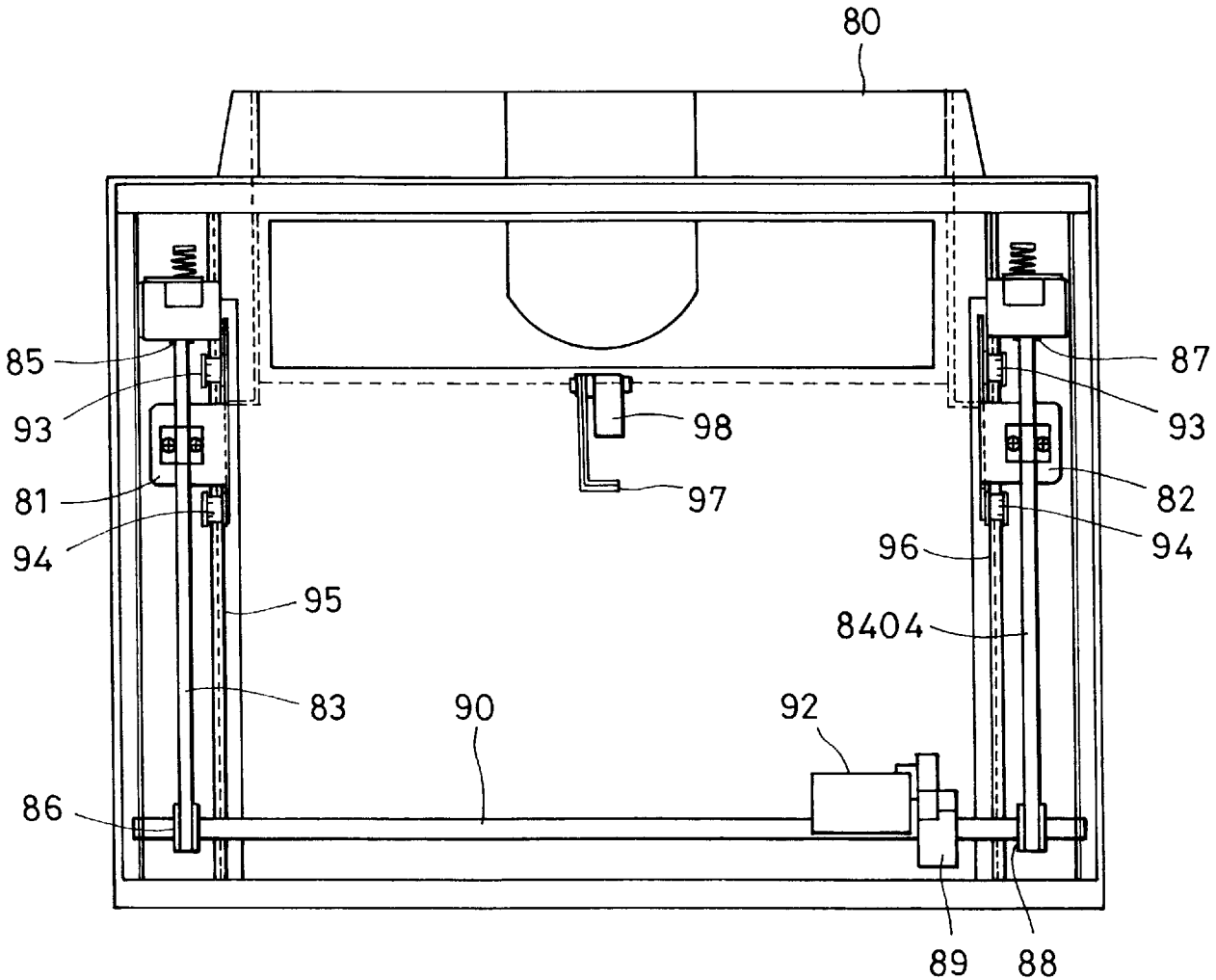
FIG. 6 is a cross-sectional view of the shift mechanism for the stack tray.
Figure 7:
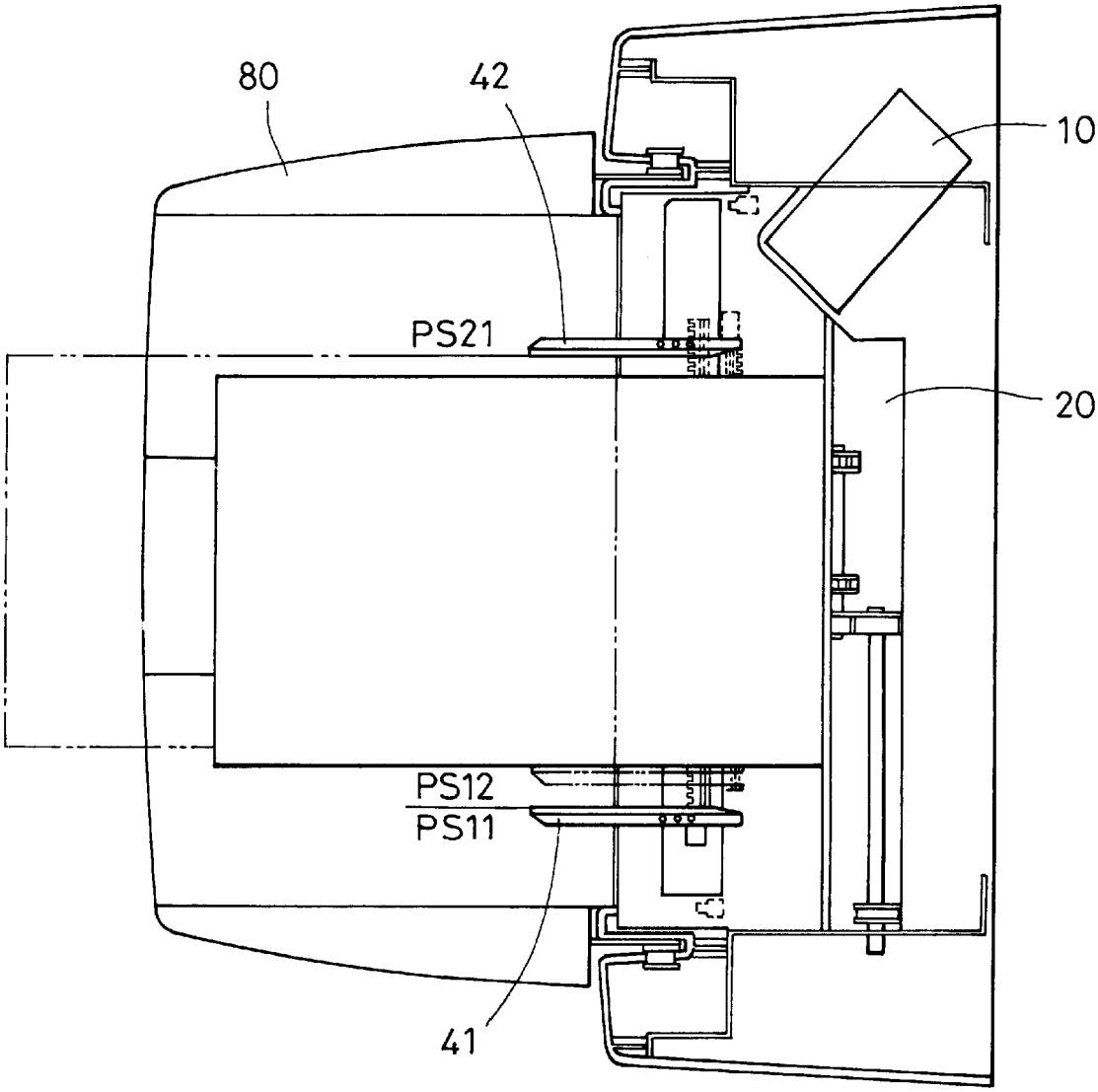
FIG. 7 is an explanatory view showing the standby positions of the aligning members in a non-sort mode and a sort mode in the sheet post-handling device.
Figure 8:
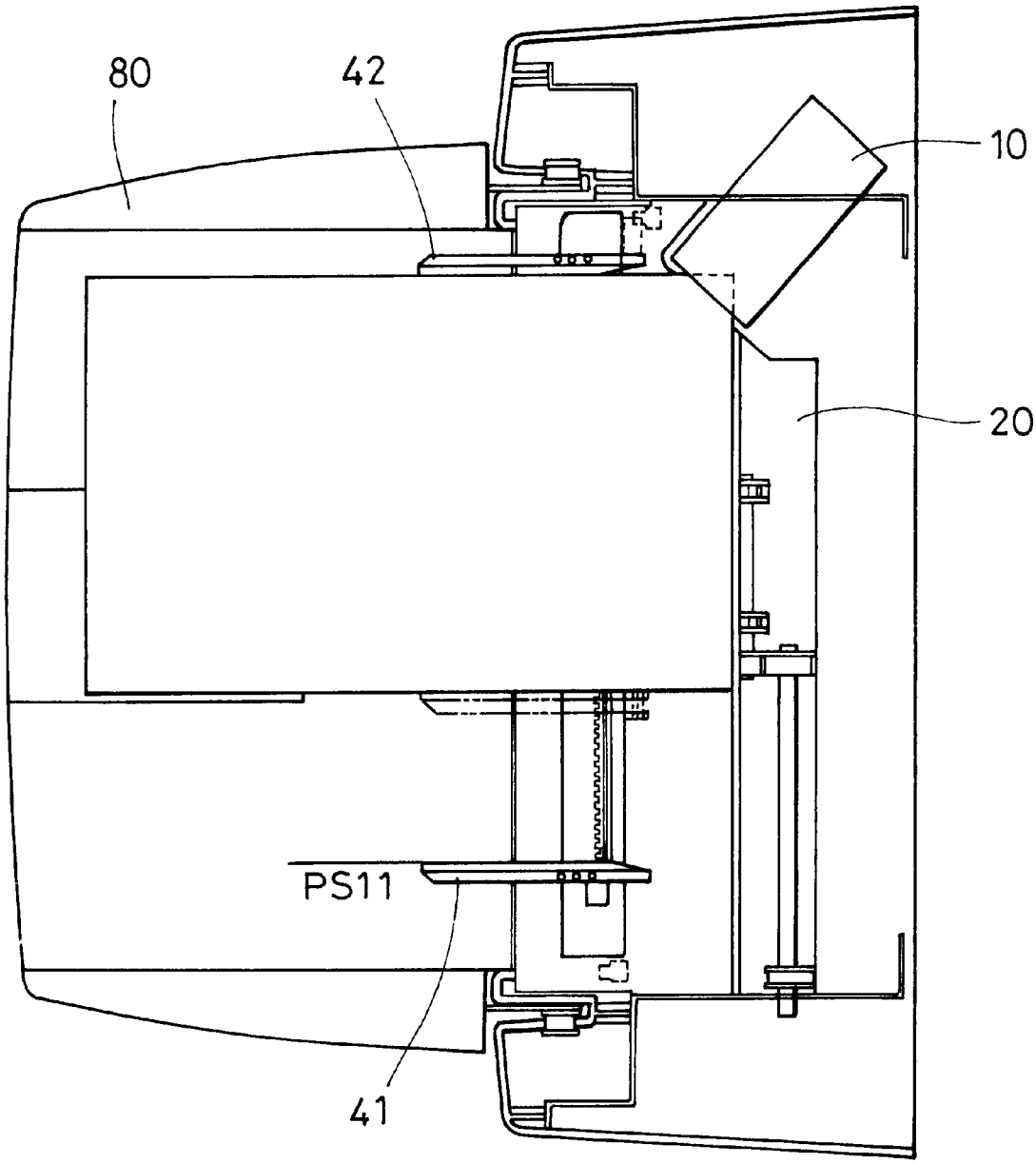
FIG. 8 is an explanatory view showing an aligning operation in a staple mode in the sheet post-handling device.
Figure 9A:
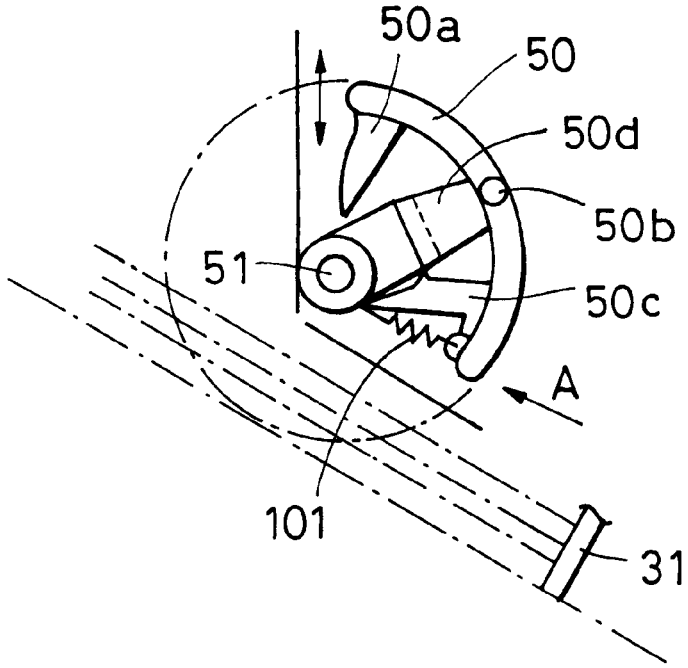
FIGS. 9A and 9B are state views showing the operation of the return roller when multiple sheets are stacked.
Figure 9B:
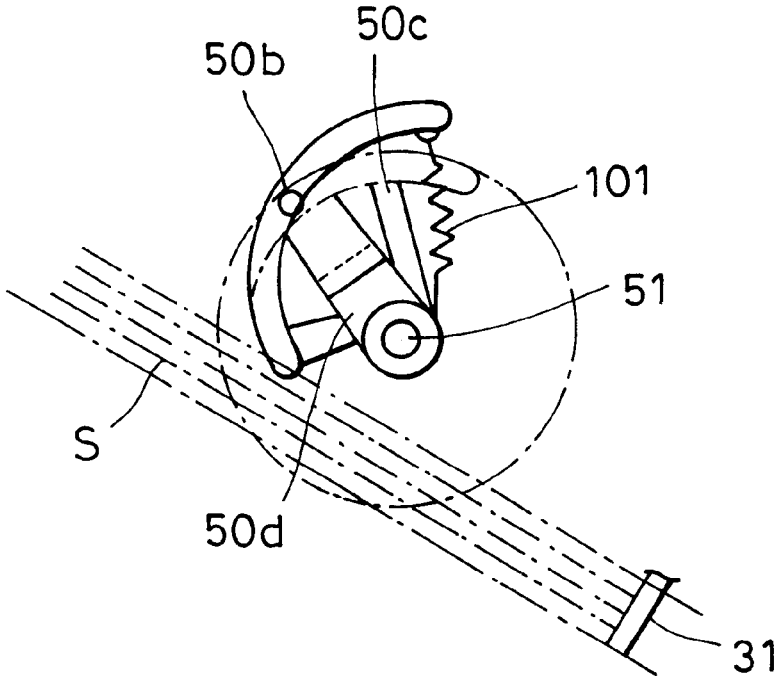
Figure 10:
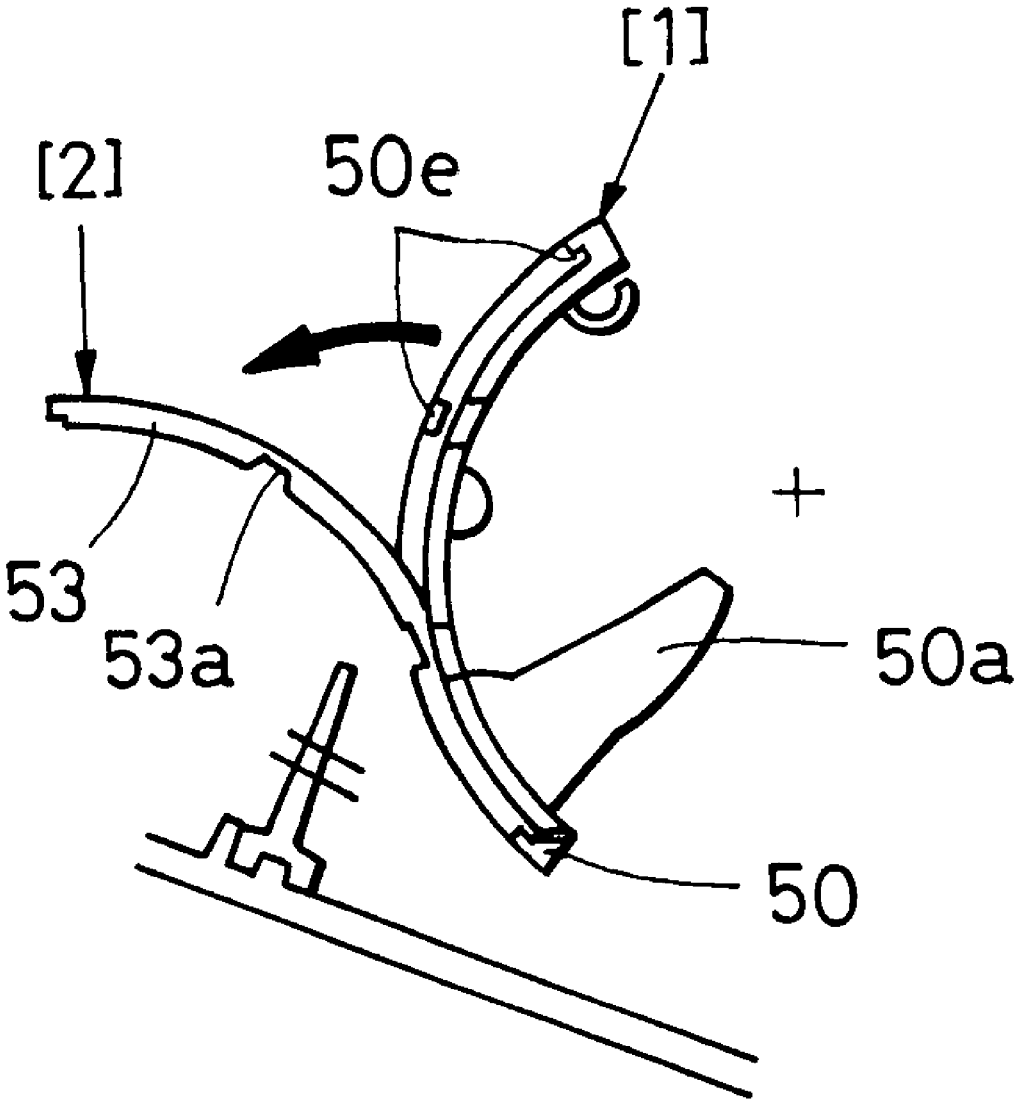
FIG. 10 is an assembly view of the return roller.

A sheet post-handling device and an image forming apparatus having the device according to the present invention will be described in detail with reference to the attached drawings. FIG. 1 is an explanatory sectional view showing the configuration of a sheet post-handling device according to the present invention, FIG. 2 is an explanatory sectional view showing the configuration of an image forming apparatus according to the present invention, FIGS. 3A, 3B, and 3C are explanatory views of return rollers and a shift mechanism for aligning members provided in a post-handling tray, FIGS. 4A, 4B, 4C, and 4D are explanatory views showing the motions of the return roller and a stack ejection belt in the sheet post-handling device, FIG. 5 is a cross-sectional view of a shift mechanism for a stack tray, FIG. 6 is a cross-sectional view of the shift mechanism for the stack tray, FIG. 7 is an explanatory view showing the standby positions of the aligning members in a non-sort mode and a sort mode in the sheet post-handling device, FIG. 8 is an explanatory view showing an aligning operation in a staple mode in the sheet post-handling device, FIGS. 9A and 9B are state views showing the operation of the return roller when multiple sheets are stacked, and FIG. 10 is an assembly view of the return roller.

Referring to FIG. 1, a sheet post-handling device (finisher) 1 according to the present invention is connected to an image forming apparatus 300. A recycle document feeder (RDF) 305 is mounted at the top of the image forming apparatus 300.

Figure 2:
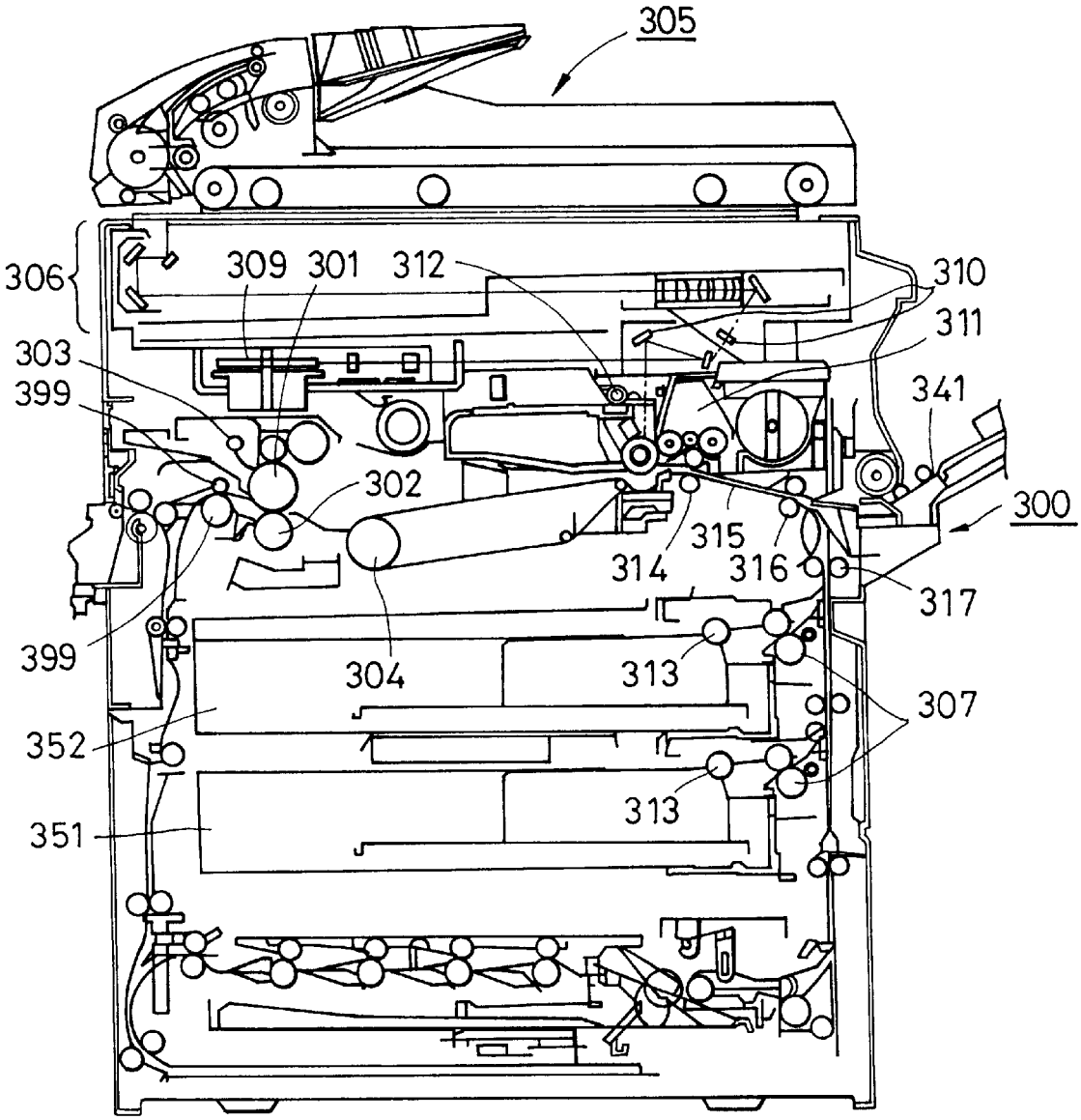
FIG. 2 is an explanatory sectional view showing the configuration of an image forming apparatus according to the present invention.

In the image forming apparatus 300, as shown in FIG. 2, documents are automatically fed by the recycle document feeder 305, and images thereon are read by an image reading section 306. According to the read image information, signals are sent from a controller (not shown) to a laser oscillator to emit laser light.

The laser light is reflected off a rotating polygon mirror 309, onto reflecting mirrors 310, and is applied onto an electrophotographic photoconductive drum 312 uniformly charged on its surface so as to serve as an image forming means, thereby forming an electrostatic latent image. The electrostatic latent image on the photoconductive drum 312 is developed by a developing device 311, and is transferred as a toner image onto a sheet S that is formed of paper, an OHP sheet, or the like.

Sheets S are appropriately and selectively delivered from a sheet cassette 351 or 352 by a pickup roller 313 constituting a sheet feeding means, are separated one by one by a separation means 307, and are conveyed to a pair of register rollers 314 and 315 by a pair of pre-register rollers 316 and 317. The skewing of the sheet S is corrected by the register rollers 314 and 315, and the sheet S is conveyed between the photoconductive drum 312 and a transfer device opposed thereto in synchronization with the rotation of the photoconductive drum 312, where the toner image formed on the photoconductive drum 312 is transferred onto the sheet S by the action of the transfer device.

Subsequently, the sheet S is guided to a pair of fixing rollers 301 and 302, and is subjected to heating and pressing by the fixing rollers 301 and 302, whereby the toner image transferred onto the sheet S is permanently fixed. Upper and lower fixing separation claws 303 and 304 are in contact with the fixing rollers 301 and 302, respectively, so as to separate the sheet S from the fixing rollers 301 and 302.

The separated sheet S is conveyed out of the image forming apparatus 300 by a pair of ejection rollers 399, and is guided to the sheet post-handling device 1 connected to the image forming apparatus 300.

The sheet post-handling device 1 and the image forming apparatus 300 are connected by engaging a lock arm 2 at the top of the sheet post-handling device 1 with a holding member 3 of the image forming apparatus 300. Furthermore, a slide unit 4 fixed to the image forming apparatus 300 is placed at the bottom of the sheet post-handling device 1, and allows the sheet post-handling device 1 to move in a sheet ejecting direction (Y-direction in FIG. 1). In order to remove a sheet remaining inside the body of the image forming apparatus 300 or the sheet post-handling device 1 because of feeding failure or for other reasons, the sheet post-handling device itself is moved in the Y-direction by turning the lock arm 2 in the X-direction, so that it can be smoothly detached from the image forming apparatus 300.

The sheet S ejected by the ejection rollers 399 is fed further downstream through a sheet path 7 formed by an upper guide 5 and a lower guide 6 in the sheet post-handling device 1. A sheet detection sensor 8 serves to detect a sheet passing therethrough and to detect a jammed sheet. A pair of ejection rollers 9 consists of an ejection roller 9*a* and an ejection roller 9*b* in pressure contact with the ejection roller 9*a*. In this embodiment, a driving shaft 9*c* is placed on the upper side so that return rollers are disposed in a small space below the sheet path 7.

A post-handling tray 30 serving as a sheet stacking means is formed as an intermediate tray for temporarily collecting sheets and for subjecting the sheets to alignment and stapling.

A stapler 10 serves to staple a stack of sheets laid on the post-handling tray 30. Although this stapler 10 is not further described in this embodiment, it has a structure similar to that of an automatic commercial stapling device that is electrically driven or motor-driven, and fastens the sheets with staples.

Stack ejection belts 60 serve to convey and eject sheets on the post-handling tray 30 in stacks into a stack tray 80.

A post-handling tray unit 20 is disposed between the conveyor section for conveying sheets from the image forming apparatus 300 and the stack tray 80 for receiving and holding stacks of sheets that have been subjected to post-handling by the post-handling tray 30.

The post-handling tray unit 20 comprises the post-handing tray 30, an aligning device 40, return rollers 50, and the stack ejection belts 60.

As shown in FIG. 1, the post-handling tray 30 is inclined so that the downstream side in the sheet feeding direction (the left side in FIG. 1) is placed on the upper side and the upstream side (the right side in FIG. 1) is placed on the lower side, and is provided with a rear end stopper 31 at the lower end thereof.

The sheet S ejected by the ejection rollers 9 slides on the post-handling tray 30 by its own weight and by the action of the return rollers 50, which will be described later, until the rear end thereof impacts the rear end stopper 31.

The post-handling tray 30 is also provided with the stack ejection belts 60. The stack ejection belts 60 move in the sheet ejecting direction by the driving of a motor 70 so as to eject stacks of sheets on the post-handling tray 30 into the stack tray 80.

Next, the aligning device 40 will be described with reference to FIG. 3A. Dashed line C represents the sheet ejection center. Aligning members 41 and 42 on the front and rear sides of the aligning device 40 are independently movable in a direction orthogonal to the sheet feeding direction (in the sheet width direction). The aligning members 41 and 42 respectively include aligning surfaces 41*a* and 42*a* standing on the post-handling tray 30 so as to regulate both sides of sheets S in abutting contact therewith, and rack gears 41*b* and 42*b* extending in the direction of width of the post-handling tray 30.

The aligning members 41 and 42 are mounted so that the aligning surfaces 41*a* and 42*a* are placed above the post-handling tray 30 and the rack gears 41*b* and 42*b* are placed below the post-handling tray 30.

The rack gears 41*b* and 42*b* are meshed with separate pinion gears 43 and 44 that are connected to separate motors 45 and 46 via gears and the like (not shown).

According to the above structure, the pinion gears 43 and 44 are turned by forward and reverse rotations of the motors 45 and 46, and the rack gears 41*b* and 42*b* meshed with the pinion gears 43 and 44 move to shift the aligning members 41 and 42 in the direction of the width of the sheets S.

The aligning members 41 and 42 are provided with sensors 48 and 49 for detecting the home positions thereof. Normally, the aligning members 41 and 42 stand by at the home positions. In this embodiment, the home position of the aligning member on the front side is set at the front limit, and the home position of the aligning member on the rear side is set at the rear limit.

Next, the return rollers 50 will be described with reference to FIGS. 3A to 3C and 4A to 4D. As shown in FIG. 4A, the return rollers 50 have a substantially arc-shaped outer peripheral surface, and are fixed to a return roller shaft 51 so as to rock in a direction nearly orthogonal to the sheet stacking surface. The return rollers 50 are urged by springs 52 to form an arc centered on the return roller shaft 51.

The return rollers 50 are mounted on the return roller shaft 51 at regular intervals in the sheet width direction, as shown in FIG. 3A. Two of the return rollers 50A, which are placed symmetrically with respect to the sheet ejection center, have friction members 53 made of silicone rubber or the like on the arc-shaped outer peripheral surfaces thereof, and the other return rollers 50B do not have friction members 53.

The return roller shaft 51 is supported by bearings 54 and 55 so as to turn relative to a front side plate 200 and a support section 201 and to move in the direction of a thickness of the sheets S laid on the post-handling tray 30. The bearings 54 and 55 are provided with pressure springs 56 and 57. FIG. 3B is a partly enlarged view of the components shown in FIG. 3A, and FIG. 3C is a view seen from the direction of arrow C in FIG. 3B. The support section 201 is formed integrally with a rear end guide 100. The front side plate 200 and the support section 201 have guide grooves 200*a* and 201*a* for vertically guiding the bearings 54 and 55.

The return roller shaft 51 is connected to the motor 70 via a pulley 58 and a timing belt 59. In response to driving by the motor 70, the return rollers 50 turn together with, and are centered on, the return roller shaft 51 in the counterclockwise direction in FIGS. 4A to 4D.

As shown in FIG. 4A, the home position of the return roller 50 is set so that the return roller 50 is not in contact with the sheets ejected into the post-handling tray 30 by the ejection rollers 9.

Figure 4B:
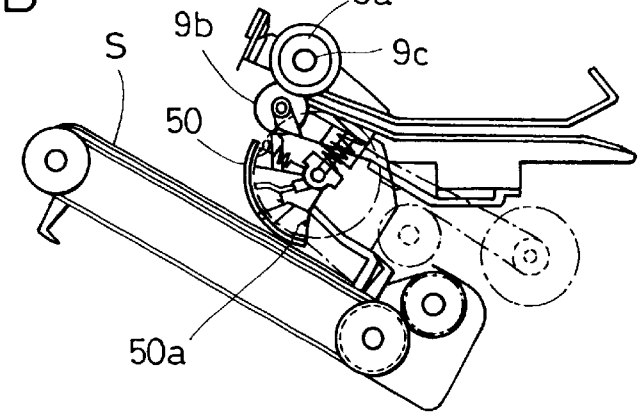

When a sheet S is ejected from the ejection rollers 9, the return rollers 50 turn one turn centered on the return roller shaft 51 in the counterclockwise direction by driving by the motor 70, as shown in FIG. 4B, and pull the sheet S until the sheet S impacts the rear end stopper 31.

If the ejected sheet S leans on the rear end guide 100, the return rollers 50 catch the rear end of the sheet S by sheet raking portions 50*a* and turn one turn centered on the return roller shaft 51 counterclockwise while raking out the rear end of the sheet S, as shown in FIGS. 4A and 4B. Thereby the sheet S reliably lands on the post-handling tray 30 and is pulled to abut against the rear end stopper 31. Subsequently, the return rollers 50 stop at the home positions, and wait for the next sheet S to be ejected. As shown in FIG. 4D, when the length of the arc of the return roller 50 is $l_1$, the length from an intersection $p_1$ of the outer periphery of the return roller 50 and the sheet stacking surface of the post-handling tray 30 to the rear end stopper 31 is $l_2$, and the length from an intersection $p_2$ of a line vertically extending downward from the outer peripheral surface of the ejection roller 9*b* and the sheet stacking surface, or an intersection $p_2$ of a line vertically extending downward from a vertical surface 100*a* of the rear end guide 100 and the sheet stacking surface to the rear end stopper 31 is $l_3$, the formula $l_1 \geqq l_2$ and $l_2 \geqq l_3$ is satisfied.

Accordingly, the rear end of the sheet ejected from the ejection rollers 9 lands within the range of $l_3$ from the sheet stopper 31, and the sheet is aligned by one turn of the return roller 50 corresponding to the length $l_1$ longer than the length $l_3$. In the configuration of this embodiment, as shown in FIGS. 4A, the outer peripheral portion of the return roller 50 is completely retracted inside the rear end guide 100 at a predetermined stop position, where sheet alignment in the widthwise direction is performed by the aligning members 41 and 42. Therefore, there is no load in alignment in the widthwise direction, and this allows for smooth sheet alignment.

As shown in FIGS. 9A and 9B, the return roller 50 is supported on the return roller shaft 51 by a support portion 50*d* so as to turn on a second fulcrum 50*b* in the direction of the arrow, and is urged in the direction of the arrow A by a spring 101 with respect to a stopper 50*c* provided in the support portion 50*d*. Therefore, even when multiple sheets are stacked on the post-handling tray 30, the return roller 50 turns counterclockwise, and the outer peripheral portion thereof contacts the upper surface of the sheets and retracts inside the periphery, as shown in FIG. 9B. This allows the return roller 50 to turn smoothly, and achieves reliable sheet alignment without producing load and tension at the contact portion.

Since the two friction members 53 are placed symmetrically with respect to the sheet ejection center in this case, pressure is uniformly applied to the sheets so that the sheets can be aligned in a well-balanced manner without skewing. Even when multiple sheets are laid on the post-handling tray 30, as shown in FIG. 4C, since the return roller shaft 51 itself can shift upward, the amount of return from one turn of return roller 50 can be stably ensured. Furthermore, in this embodiment, the friction members 53 have engaging recesses 53*a*, as shown in FIG. 10, and are detachably mounted by engaging the engaging recesses 53*a* with engaging projections 50*e* formed in the return roller 50.

Next, the stack ejection belt 60 will be described with reference to FIGS. 3A and 4A to 4D. The stack ejection belt 60 has a hook portion 60*a*, as shown in FIGS. 4A to 4D, is looped over pulleys 61 and 62, and is connected to the motor 70 via a gear 63, a one-way gear 64, and the timing belt 59. The one-way gear 64 transmits the driving force to the gear 63 only when the motor 70 turns clockwise.

When the return roller 50 pulls the last sheet S so that the sheet S contacts the rear end stopper 31, the stack ejection belt 60 moves along the inclination of the post-handling tray 30 in the direction of the arrow A in FIG. 4D (in the sheet feeding direction) in response to the driving by the motor 70, and ejects the stack of sheets S, which have been aligned and stapled on the post-handling tray 30, into the stack tray 80.

Next, the structure of the stack tray 80 will be described with reference to FIGS. 5 and 6. The stack tray 80 has a sub-tray 79 built therein. By drawing the sub-tray 79 out, sheets of large sizes, for example, A3 and B4 sizes, can be stacked therein.

The stack tray 80 is supported by tray support plates 81 and 82 on both sides, and timing belts 83 and 84 are fixed to the tray support plates 81 and 82.

The timing belt 83 is looped over pulleys 85 and 86, and the timing belt 84 is looped over pulleys 87 and 88. The pulleys 86 and 88 are fixed on a driving shaft 90 on which a driving gear 89 is fixed, and are connected to a driving motor 92 via a train of gears 91.

The tray support plates 81 and 82 are provided with rollers 93 and 94 that are rotatable with respect to roller guides 95 and 96. The rollers 93 and 94 move in the vertical direction (in the Z-direction in FIG. 5) along the roller guides 95 and 96 in response to driving by the driving motor 92.

A sheet surface height detection sensor 97 serves to detect the height of a stack of sheets, and to adjust the height of the surface of the sheets stacked on the stack tray 80 with respect to the post-handling tray 30 to a predetermined height.

Next, description will be given of the travel of sheets S in the sheet post-handling device 1 with reference to FIGS. 1 and 7 to 10. First, description will be given of an operation to be performed when a non-sort mode is selected by a user through a control section (not shown) in the body of the image forming apparatus 300. When the user places a document on the recycle document feeder 305 and turns on a start key (not shown), an image is formed on a sheet S in the image forming apparatus 300, and the sheet S is output from the ejection rollers 399 of the image forming apparatus 300. Then, the ejection rollers 9 of the sheet post-handling device 1 turn to guide and carry the ejected sheet S in the sheet post-handling device 1.

As shown in FIG. 7, when there is no sheet in the post-handling tray 30, that is, when the first sheet S in a job is to be ejected, the aligning members 41 and 42 on the front and rear sides, which have been on standby at the home positions, move to the positions slightly offset outward from both sides of the sheet S (PS11, PS21).

The ejected sheet S starts to move toward the rear end stopper 31 by its own weight. In addition, the return rollers 50 that are stopped at the home position turn counterclockwise in FIG. 1 in response to driving by the motor 70, thereby promoting the movement of the sheet S toward the rear end stopper 31.

When the rear end of the sheet S contacts the rear end stopper 31 and the sheet S reliably stops, the aligning member 42 on the rear side stays at a position PS21 to serve as the reference, as shown in FIG. 7. In contrast, the aligning member 41 on the front side moves to a position PS12 to align the sheet S at the first aligning position.

Next, description will be given of an operation to be performed when the user selects a staple-and-sort mode. When the user places a document on the recycle document feeder 305 and turns on the start key (not shown), an image is formed on a sheet S in the image forming apparatus 300, the ejection rollers 9 of the sheet post-handling device 1 turn, and the sheet S is ejected from the ejection rollers 399 of the image forming apparatus 300. The ejected sheet S is guided to the sheet post-handling device 1, is carried therein, and is ejected into the post-handling tray 30 by the ejection rollers 9.

The ejected sheet S starts to move toward the rear end stopper 31 by its own weight. In addition, the return rollers 50 that have stopped at the home positions turn counter-clockwise in FIG. 1 in response to driving by the motor 70, thereby promoting the movement of the sheet S toward the rear end stopper 31.

When the rear end of the sheet S contacts the rear end stopper 31 and the sheet S stops, the aligning member 41 stops at the home position, and the aligning member 42 carries and aligns the sheet S ejected on the rear end stopper 31 to a stapling position (FIG. 8).

When all the sheets in the first stack are ejected and aligned in the post-handling tray 30, they are stapled by the stapler 10. The sheets on the post-handling tray 30 are ejected in a stack onto the stack tray 80 by the stack ejection belts 60.

While the present invention has been described with reference to what are presently considered to be the preferred embodiment, it is to be understood that the invention is not limited to the disclosed embodiment. On the contrary, the invention is intended to cover various modifications and equivalent arrangements included within the spirit and scope of the appended claims.

What is claimed is:

1. A sheet handling device, comprising:

sheet stacking means for stacking sheets;

ejection means for ejecting sheets to said sheet stacking means;

a sheet end stopper for holding ends of the sheets stacked in said sheet stacking means; and at least one rotary member for aligning the sheets stacked in said sheet stacking means with said sheet end stopper, said at least one rotary member having an arc-shaped member formed by a portion of a circumference of a circle.

2. A sheet handling device according to claim 1, wherein said at least one rotary member is movable in a direction substantially perpendicular to a sheet stacking surface of said sheet stacking means.

3. A sheet handling device according to claim 2, wherein said at least one rotary member includes a rotation shaft, a support member for supporting said rotation shaft in engagement therewith, a guide portion provided in said support member, and slide guide means in engagement with said guide portion for supporting said support member slidably in a direction substantially perpendicular to said sheet stacking surface of said sheet stacking means.

4. A sheet handling device according to claim 1, wherein, when a circumferential length of said arc-shaped member of said at least one rotary member is $l_1$, a length from a contact point between said sheet stacking surface of said sheet stacking means and said arc-shaped member of said at least one rotary member to said sheet end stopper is $l_2$, and a length from an intersection of a line perpendicularly extending from said the outer peripheral surface of said ejection means on a downstream side and said sheet stacking surface of said sheet stacking means to said sheet end stopper is $l_3$, the formula $l_1 \geqq l_2$ and $l_2 \geqq l_3$ is satisfied.

5. A sheet handling device according to claim 1, wherein said at least one rotary member has a turning center on the arc-shaped member with respect to rotation center.

6. A sheet handling device according to claim 5, wherein said at least one rotary member has a support portion fixed to said rotation center, and said arc-shaped member is supported by said support portion so as to turn on said turning center in relation to said support portion.

7. A sheet handling device according to claim 6, wherein said support portion is provided with a positioning portion so that said arc-shaped member aligns with a circle formed when said rotary member turns, and further comprising urging means for urging said arc-shaped member toward said positioning portion.

8. A sheet handling device according to claim 1, further comprising a high-friction member mounted on said arc-shaped member of said at least one rotary member.

9. A sheet handling device according to claim 8, wherein said high-friction member is detachable from said at least one rotary member.

10. A sheet handling device according to claim 8, wherein said high-friction member is provided at at least two points symmetrical with respect to an ejection center of the sheets ejected from said ejection means.

11. A sheet handling device according to any one of claims 8 to 10, wherein said high-friction member is made of rubber.

12. A sheet handling device according to claim 1, further comprising a sheet end guide member for guiding ends of the sheets ejected from said ejection means from a position adjacent to said ejection means to said sheet end stopper.

13. A sheet handling device according to claim 12, wherein said at least one rotary member includes a rotation shaft and said arc-shaped member of said at least one rotary member are placed between said ejection means and said sheet end guide member when said rotary member stops at a predetermined position, and said arc-shaped member is placed between said sheet end guide member and said sheet stacking means when said rotary member is turned by a predetermined angle.

14. A sheet handling device according to claim 12 or 13, wherein said at least one rotary member has, except on said arc-shaped member, a raking portion placed below said ejection means and above said sheet stacking means during rotation and for pressing the end of the sheets adjacent to said sheet end guide member substantially downward.

15. An image forming apparatus comprising forming means for forming an image on a sheet and a sheet handling device, wherein said sheet handling device comprises:

sheet stacking means for stacking sheets;

ejection means for ejecting sheets to said sheet stacking means;

a sheet end stopper for holding ends of the sheets stacked in said sheet stacking means; and at least one rotary member for aligning the sheets stacked in said sheet stacking means with said sheet end stopper, said at least one rotary member having an arc-shaped member formed by a portion of a circumference of a circle.

16. An image forming apparatus according to claim 15, wherein said at least one rotary member is movable in a direction nearly perpendicular to a sheet stacking surface of said sheet stacking means.

17. An image forming apparatus according to claim 16, wherein said at least one rotary member includes a rotation shaft, a support member for supporting said rotary shaft in engagement therewith, a guide portion provided in said support member, and a slide guide means in engagement with said guide portion for supporting said support member slidably in a direction substantially perpendicular to said sheet stacking surface of said sheet stacking means.

18. An image forming apparatus according to claim 15, wherein, when a circumferential length of said arc-shaped member of said at least one rotary member is $l_1$, a length from a contact point between said sheet stacking surface of said sheet stacking means and said arc-shaped member of said at least one rotary member to said sheet end stopper is $l_2$, and a length from an intersection of a line perpendicularly extending from the outer peripheral surface of said ejection means on a downstream side and said sheet stacking surface of said sheet stacking means to said sheet end stopper is $l_3$, the formula $l_1 \geqq l_2$ and $l_2 \geqq l_3$ is satisfied.

19. An image forming apparatus according to claim 15, wherein said at least one rotary member has a turning center on said arc-shaped member with respect to a rotation center.

20. An image forming apparatus according to claim 19, wherein said at least one rotary member has a support portion fixed to said rotation center, and said arc-shaped member supported by said support portion so as to turn on said turning center in relation to said support portion.

21. An image forming apparatus according to claim 20, wherein said support portion is provided with a positioning portion so that said arc-shaped member aligns with a circle formed when said rotary member turns, and further comprising urging means for urging said arc-shaped member toward said positioning portion.

22. An image forming apparatus according to claim 15, further comprising a high-friction member mounted on said arc-shaped member of said at least one rotary member.

23. An image forming apparatus according to claim 22, wherein said high-friction member is detachable from said at least one rotary member.

24. An image forming apparatus according to claim 22, wherein said high-friction member is provided at at least two points symmetrical with respect to an ejection center of the sheets from said ejection means.

25. An image forming apparatus according to any one of claims 22 to 24, wherein said high-friction member is made of rubber.

26. An image forming apparatus according to claim 15, further comprising a sheet end guide member for guiding ends of the sheets ejected from said ejection means from a position adjacent to said ejection means to said sheet end stopper.

27. An image forming apparatus according to claim 26, wherein said at least one rotary member includes a rotation shaft and said arc-shaped member of said at least one rotary member are placed between said ejection means and said sheet end guide member when said rotary member stops at a predetermined position, and said arc-shaped member is placed between said sheet end guide member and said sheet stacking means when said rotary member is turned by a predetermined angle.

28. A sheet handling device according to claim 26 or 27, wherein said at least one rotary member has, except on said arc-shaped member, a raking portion placed below said ejection means and above said sheet stacking means during rotation and for pressing the end of the sheets adjacent to said sheet end guide member substantially downward.

29. A sheet handling device, comprising:

sheet stacking means for stacking sheets;

ejection means for ejecting sheets with an image formed thereon to said sheet stacking means;

at least one rotary member placed above said sheet stacking means and having an arc-shaped member around a portion of a circumference of said at least one rotary member; and a sheet end stopper for holding ends of the sheets stacked in said sheet stacking means, wherein said at least one rotary member is movable in a direction substantially perpendicular to a sheet stacking surface of said sheet stacking means, wherein said sheet sacking means is inclined so that the downstream side thereof in the sheet ejecting direction is above an upstream side, and wherein, when a circumferential length of said arc-shaped member of said at least one rotary member is $l_1$, a length from a contact point between said sheet stacking surface of said sheet stacking means and said arc-shaped member of said at least one rotary member to said sheet end stopper is $l_2$, and a length from an intersection of a line perpendicularly extending from the arc-shaped member of said ejection means on a downstream side and said sheet stacking surface of said sheet stacking means to said sheet end stopper is $l_3$, the formula $l_1 \geqq l_2$ and $l_2 \geqq l_3$, is satisfied.

* * * * *

UNITED STATES PATENT AND TRADEMARK OFFICE

CERTIFICATE OF CORRECTION

PATENT NO. : 6,398,214 B1
DATED : June 4, 2002
INVENTOR(S) : Junichi Moteki et al.

It is certified that error appears in the above-identified patent and that said Letters Patent is hereby corrected as shown below:

Column 1,
Line 18, “apparatuses,” should read -- apparatus, --.

Column 9,
Line 24, “are” should read -- is --.
Line 25, “embodiment,” should read -- embodiments, --.

Signed and Sealed this

Twenty-seventh Day of August, 2002

*Attest:*

*Attesting Officer*

JAMES E. ROGAN
*Director of the United States Patent and Trademark Office*